United States Patent [19]

Gerstmann et al.

[11] 4,338,888

[45] Jul. 13, 1982

[54] HIGH EFFICIENCY WATER HEATING SYSTEM

[75] Inventors: Joseph Gerstmann, Framingham; Andrew D. Vasilakis, Bedford, both of Mass.

[73] Assignee: Advanced Mechanical Technology, Inc., Newton, Mass.

[21] Appl. No.: 149,937

[22] Filed: May 14, 1980

[51] Int. Cl.[3] ..... F22B 5/00

[52] U.S. Cl. ..... 122/16; 122/18; 122/367 C; 431/202

[58] Field of Search ..... 122/13 R, 17, 16, 18, 122/19, 31 R, 451 R, 448 S, 406 S; 432/222; 431/202

[56] References Cited

U.S. PATENT DOCUMENTS

| | | | |
|---|---|---|---|
| 1,862,630 | 6/1932 | Morrow | 122/18 |
| 2,179,496 | 11/1939 | Czeschin | 122/16 |
| 2,440,998 | 5/1948 | Alexander | 122/16 |
| 2,549,755 | 4/1951 | Burwell | 122/16 |
| 3,388,692 | 6/1968 | Hale | 122/367 C |
| 3,707,142 | 12/1972 | Kobayashi | 122/17 |
| 3,895,607 | 7/1975 | Johnson | 122/367 R |
| 3,917,442 | 11/1975 | Zagoroff | 432/222 |
| 3,954,386 | 5/1976 | Harpenslager et al. | 431/202 |
| 4,222,350 | 9/1980 | Pompei et al. | 122/367 C |

FOREIGN PATENT DOCUMENTS

| | | | |
|---|---|---|---|
| 2846120 | 4/1979 | Fed. Rep. of Germany | 122/17 |

*Primary Examiner*—Henry C. Yuen

*Attorney, Agent, or Firm*—Hamilton, Brook, Smith & Reynolds

[57] ABSTRACT

A high efficiency gas fired residential water heater includes an insulated, plastic-lined storage tank. The water in the tank is heated by an external heat exchanger which defines a water-walled combustion chamber. The fuel gas and combustion air burned in the chamber are premixed to a near stoichiometric mixture without the use of a blower. Under the force of line pressure or less, the fuel gas is accelerated into an aspirator/mixer which premixes an amount of air sufficient for complete combustion of the fuel gas. The water-walled combustion chamber is particularly suited for substantial recovery of the heat of a pilot flame. The pilot products of combustion heat water at the upper end of the combustion chamber without causing significant convective flow throughout the heat exchanger.

12 Claims, 11 Drawing Figures

Fig. 2
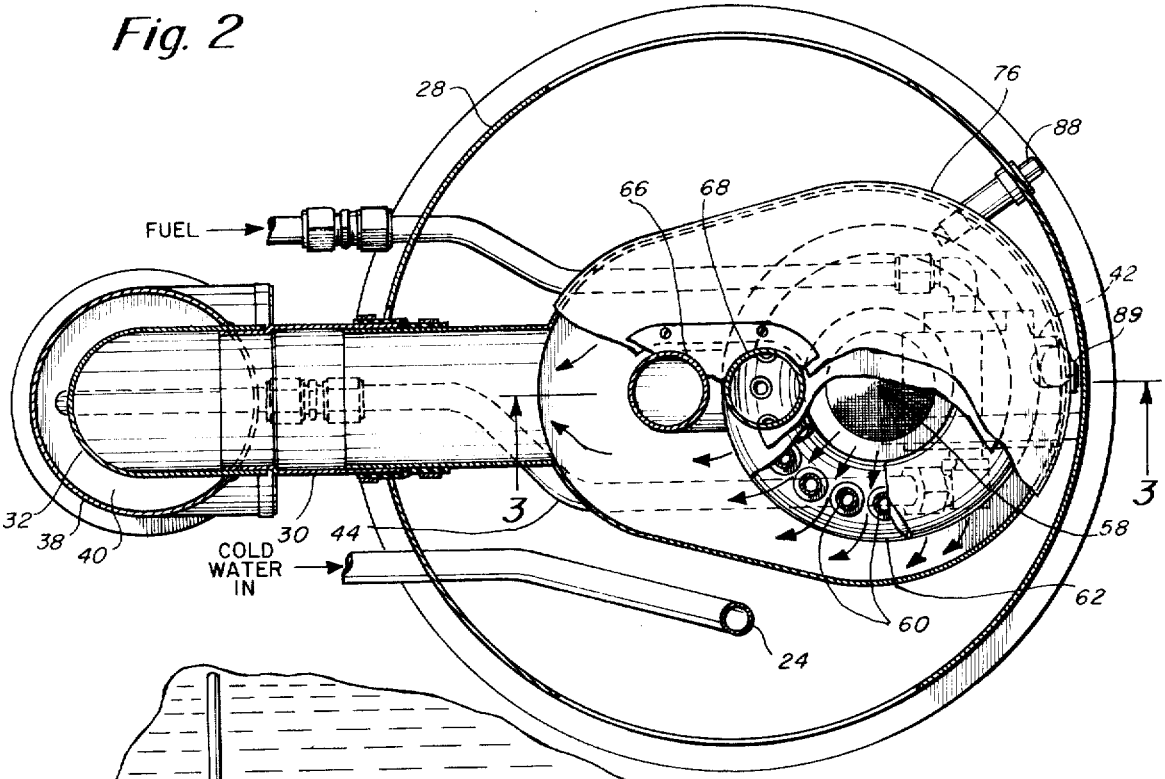
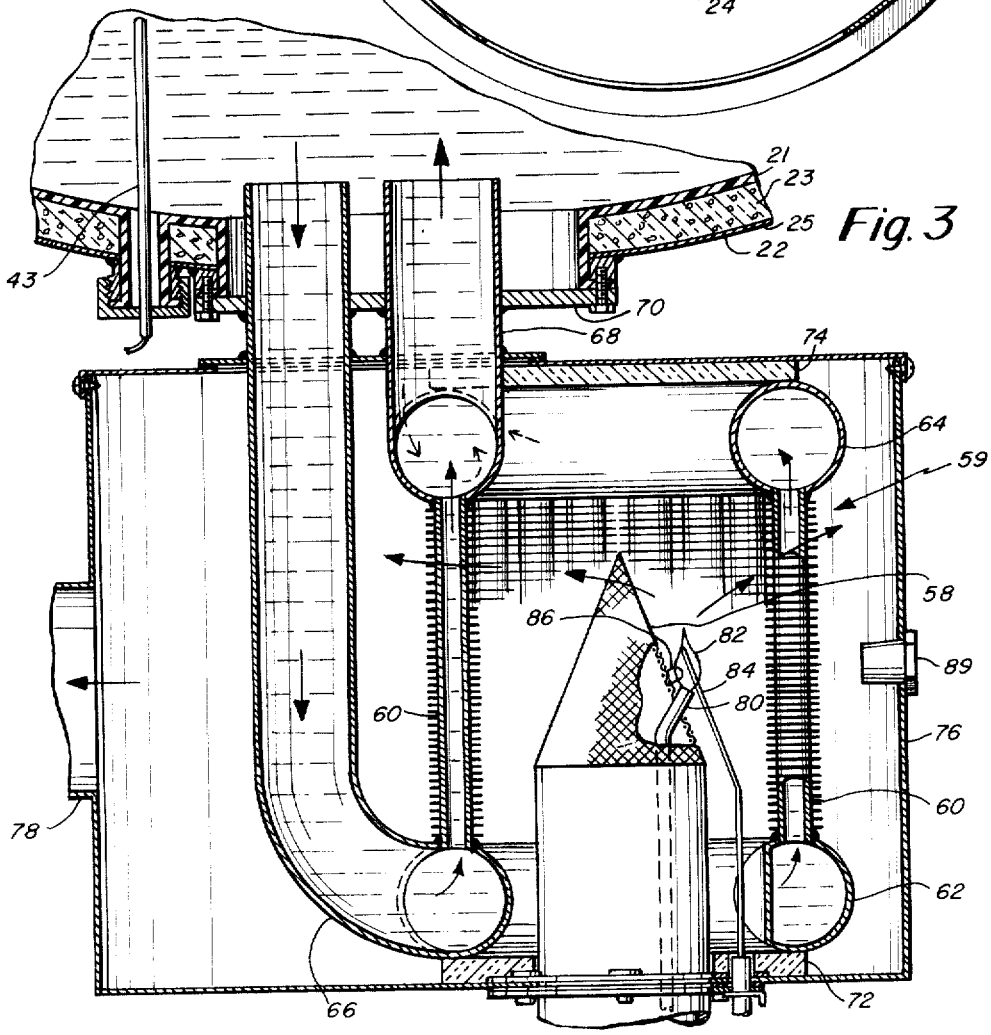
Fig. 3

HIGH EFFICIENCY WATER HEATING SYSTEM

TECHNICAL FIELD

This invention relates to water heating systems and, more particularly, to water heating systems of moderate size which are particularly adapted for use in providing residential domestic hot water requirements.

BACKGROUND

Residential gas-fired water heaters commonly comprise a storage tank in which hot water available for use is stored, and a natural-draft, naturally-aspirated burner which heats the stored water by causing products of combustion to flow over surfaces of the storage vessel. Commonly, the storage tank is a cylindrical shape, is made of "glass-lined" steel, and has a centrally located flue through which products of combustion flow. The flue usually contains baffles and serves as a heat exchanger to transmit heat from the combustion products to the water stored within the vessel. While such water heaters can be simply and economically produced, they are subject to corrosion and, for reasons discussed below, are inefficient.

The combustion assembly commonly used in residential storage type water heaters is of the type in which natural gas initially at line pressure or less aspirates and premixes with an amount of air that is insufficient for complete combustion. Such systems rely upon "secondary air" in the combustion chamber for the additional air necessary to complete combustion. Because there are zones adjacent the burner where gas/air mixtures range from overly rich to overly lean, there is a formation of oxides of nitrogen, an undesirable pollutant. Additionally, because the burn-out of carbon monoxide is limited by the rate of mixing of secondary air, carbon monoxide is not rapidly eliminated. For this reason, large combustion chambers are required for burn-up of carbon monoxide.

Conventional center-flue water heaters which employ secondary air for combustion rely upon the buoyancy of the heated air in the central flue to create a draft which induces the flow of secondary air into the combustion chamber. During the off-cycle, the temperature of the air in the central flue is still sufficiently elevated with respect to normal ambient temperatures that a significant "stack effect" is created. This stack effect produces sufficient draft to produce secondary air flows during the off-cycle which are of similar magnitude to the flow of secondary air during the burner on-cycle. This unwanted convection of secondary air increases the rate of heat loss from the stored water through the walls of the central flue.

Generally, such prior art water heaters utilize a standing pilot to provide a ready source of ignition for the burner. The pilot burner is located beneath the storage vessel, alongside the primary burner. Because of its location relative to the heat exchanging surfaces of the storage vessel, the pilot products of combustion become mixed with air convecting up the central flue and actually increase such unwanted free convection. Generally, the amount of convected air mixed with pilot products is sufficiently high that the final pilot products exhaust temperature is below the temperature of the stored water. Thus, rather than providing heat to the stored water, the pilot products are diluted by cooler air to the exhaust that they extract heat from the stored water.

In efforts to reduce the production of pollutants and to reduce the off-cycle heat losses from the storage tank, power burners have been suggested. See, for example, U.S. Pat. Nos. 3,823,704 to Daugirda et al. and 3,854,454 to Lazaridis. In such systems, an electric blower is used to draw combustion air into the assembly and to provide a near stoichiometric mix of fuel gas and air upstream of the burner. As a result, there are no overly rich or overly lean zones adjacent the burner to promote the formation of oxides of nitrogen, and the burnout of carbon monoxide is not limited by the mixing of secondary air. Further, because there is no requirement for secondary air, the combustion chamber can be substantially closed but for the burner and exhaust flue so that off-cycle convection through the combustion chamber and in heat exchange relationship with the storage tank is minimized. A major fault of such systems is that the blower used in the forced draft and mixing is costly, requires costly electrical power, and has a limited life.

In the Lazaridis patent, the problems of corrosion of the storage tank are avoided by the use of a plastic lined tank. Also, a center flue is not utilized so that there is little heating of the air in the flue during the off-cycle and the undesired resultant convection through the flue is minimized. The use of a plastic lined storage tank without a center flue does present problems of heat exchange between the combustion products and stored water during the on-cycle. Lazaridis overcomes that problem by use of a heat pipe which leads from the combustion chamber to the interior of the storage tank. Unfortunately, the heat pipe results in a further increase in the cost of the heater system, and the life of the heat pipe, which must remain hermetically sealed, is limited.

Daugirda et al. provide for heat exchange to the water and the storage tank by means of a water walled combustion chamber. But water is driven through the tubes in that chamber by a circulator. Like the blower used for premixing of the gas and air, the circulator is costly, requires electrical power, and has a limited life.

An object of this invention is to provide a storage-type water heater, particularly when utilizing a plastic lined storage vessel, which has high recovery efficiency with low standby losses and which minimizes the formation of noxious pollutants. A further object of the invention is to provide such a water heater which can be manufactured at little additional cost over conventional center-flue water heaters and which does not utilize any electrically powered motors.

To avoid the inefficiencies which result from the use of a pilot burner during the off-cycle of the water heater, the use of electronic ignition systems is widely promoted. Such electronic ignition systems present a substantial cost factor and are more likely to fail than are the simple pilot ignition systems.

A further object of the invention is to provide a water heater system in which a pilot burner may be used for ignition with recovery of a substantial portion of the heat generated by the standing pilot. With high recovery of heat from the pilot frame, the advantages of simplicity and durability of the conventional pilot can be retained without concern for thermal losses.

DISCLOSURE OF THE INVENTION

A primary feature of hot water systems embodying this invention is that the fuel gas and combustion air are premixed to a near stoichiometric mixture without the use of a blower. Under the force of line pressure or less, the fuel gas is accelerated into an aspirator/mixer. The accelerated fuel gas aspirates combustion air to provide the stoichiometric mix to the burner. In that way, the advantages of a power burner are obtained without the disadvantages arising from the use of an electric blower.

Preferably, the combustion chamber is a water walled chamber positioned externally of the storage tank. Water conducting tubes are preferably arranged in a cylindrical array to define the combustion chamber, and those tubes are in communication with the heated water in the storage tank to provide for natural convective flow of the water through the tubes.

Preferably, a pilot burner is used for ignition of the primary burner. The pilot burner is positioned within the combustion chamber such that the pilot products of combustion flow in a strata over cooler air in the combustion chamber. The pilot products of combustion heat water at the upper end of the combustion chamber for maximum recovery from the pilot products. Air convection through the system during the off-cycle can be further reduced by preheating incoming air by warmer exiting gases in the flue.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 2 is a cross sectional view of the embodiment of FIG. 1 taken along lines 2—2;

FIG. 3 is an enlarged elevational sectional view of the combustion chamber and heat exchanger portion of the embodiment of FIG. 1;

DESCRIPTION OF PREFERRED EMBODIMENTS

Figure 1:
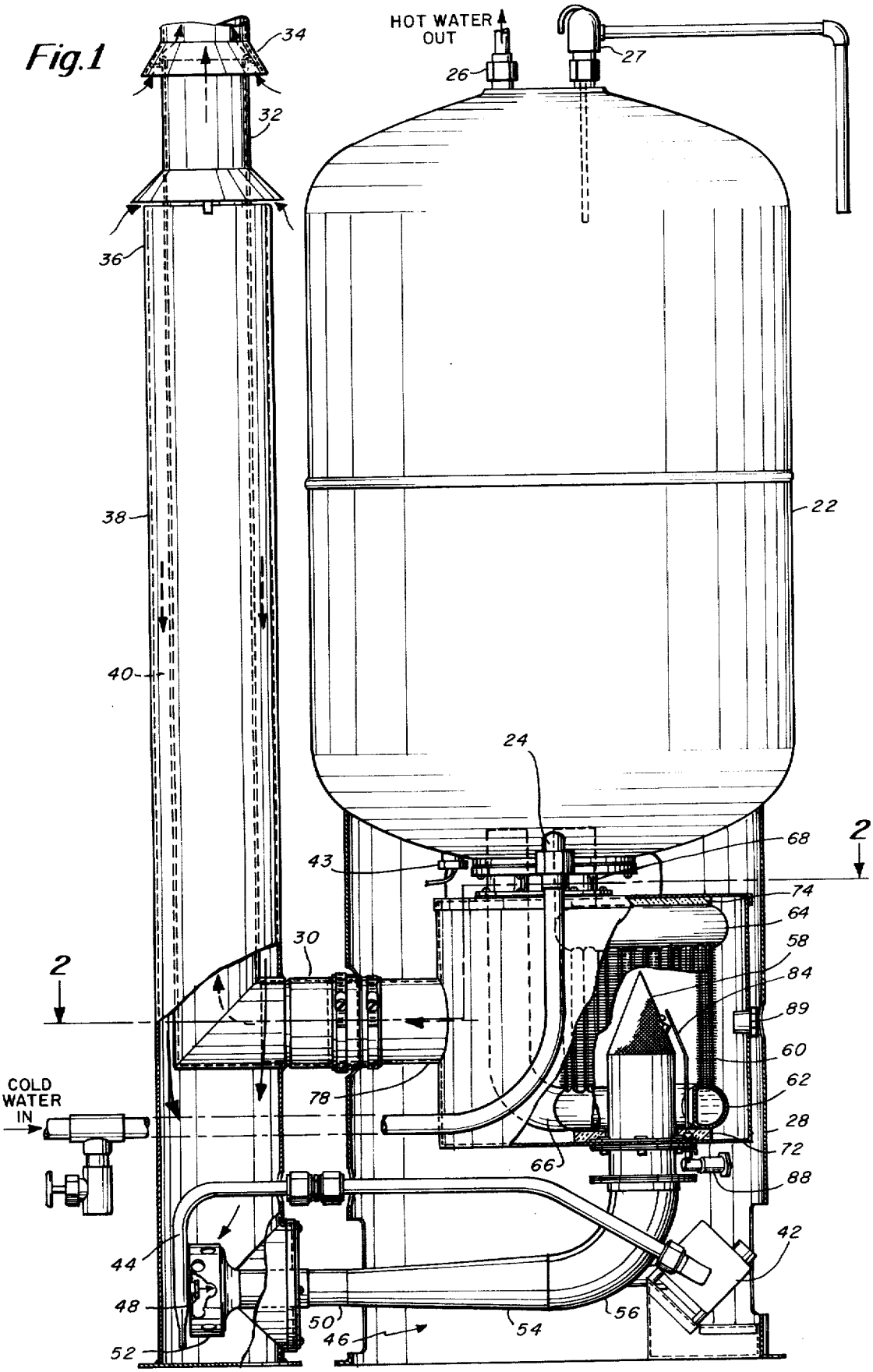
FIG. 1 is an elevational view, partially broken away, of a preferred embodiment of this invention.

As shown in FIG. 1, a hot water storage tank 22 has a cold water inlet 24 and a hot water outlet 26. As shown in FIG. 3, the storage tank 22 is preferably made of a preformed plastic liner 21 surrounded by insulation 23, such as a foam insulation, and a metal housing 25. The tank 22 is supported on a stand 28 which also houses most of the combustion assembly for heating the hot water. A temperature/pressure relief valve 27 is connected to the storage tank.

The products of combustion from the combustion assembly pass through the stand 28 in a flue connection 30 and are directed upwardly through the flue 32 to the exterior of the building. A draft hood assembly 34 controls draft in the flue. Combustion air supplied to the combustion assembly is introduced into the system over the top end 36 of a sleeve 38 surrounding the flue 32. The air passes downward through the annulus 40 between the flue and sleeve and is thus preheated by the products of combustion in the flue.

Natural gas is introduced into the system at line pressure through a thermostatically activated combination solenoid and pressure regulating valve 42. The valve 42 responds to the temperature of the water in tank 22 through a temperature sensor 43. The gas is directed through gas pipe 44 to an aspirator/mixer 46. Under the force of a pressure less than line pressure, the fuel gas is accelerated by a nozzle 48 and is directed into a mixer throat 50. The jet of fuel gas draws combustion air from within the sleeve 38 into an air inlet chamber 52 and through the mixer throat 50. The gas and aspirated air are thoroughly mixed in the mixer 50 and the pressure of the mixture is increased in a diffuser 54. The gas/air mixture, a homogenous, near stoichiometric mixture for complete combustion of the gas, is then directed upwardly by an elbow 56 to a burner 58. The burner is conically shaped and is formed of foraminous sheet material such as a perforated metal sheet or a screen. Burners of other shapes may also be used. Because the gas and combustion air are completely premixed to the proper mixture for complete combustion, the production of oxides of nitrogen and of carbon monoxide are minimized.

The combustion chamber is a water walled chamber defined by a heat exchanger assembly 59. Vertical finned tubes 60 are arranged in a cylindrical array. The heat exchanger tubes 60 which define the combustion chamber extend between a lower, toroidal header 62 and an upper, toroidal header 64. The headers 62 and 64 are in liquid communication with the storage tank 22 through respective downcomer and riser pipes 66 and 68. The pipes 66 and 68 are connected to the storage tank 22 by means of a plate 70 bolted to the tank. Lower and upper end caps 72 and 74 of refractory material assure that all products of combustion pass from the burner 58 through the array of tubes 60. Water within those tubes is efficiently heated. The heating of the water in the tubes 60 relative to the water in the downcomer tube 66 results in a natural convective flow of water from the storage tank into the tubes 60 and of hot water back into the storage tank 22.

The external heat exchanger assembly is of particular advantage in use with a plastic lined storage tank. Such a storage tank generally can not withstand the high temperatures imposed on the liner by an internal heat exchanger such as in a center flue type.

The combustion chamber is surrounded by a metal shroud 76 which directs the products of combustion to a flue outlet 78. Because the fuel gas and combustion air are completely premixed upstream of the burner 58, the shroud can be completely closed but for the burner and the exhaust flue. No secondary air is necessary for complete combustion of the gas.

One hundred percent premixing of the gas and air provides a very hot, concentrated, well mixed flame. Because carbon monoxide is quickly oxidized in that flame a small combustion chamber can be used. In this system, the combustion chamber within the heat exchange tubes 70 has a volume of about 3 liters; whereas in conventional systems which require secondary air the combustion chamber of a like-capacity system has a volume of more than 10 liters. The small combustion chamber minimizes the expense of the copper tubing used in the heat exchanger assembly and, as will be discussed below, provides for efficient recovery of heat from the pilot flame.

Figure 4:
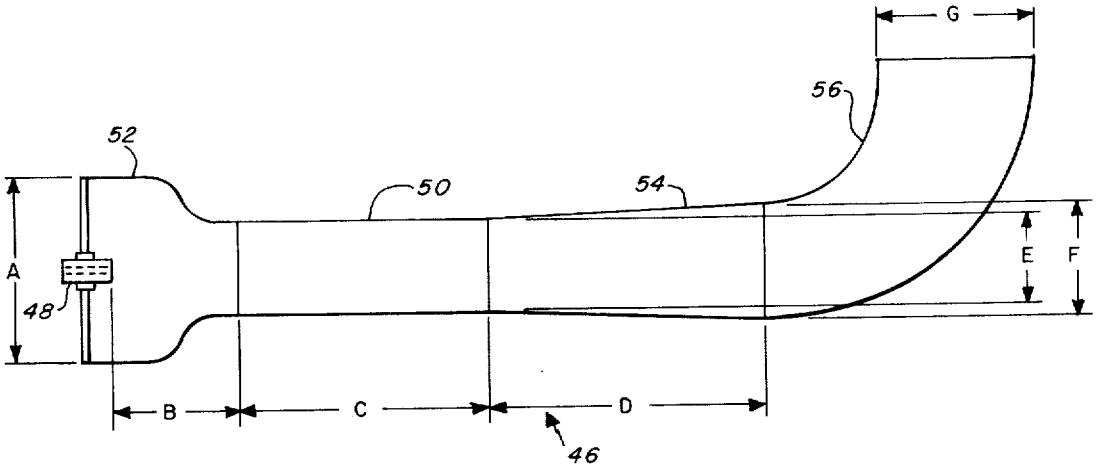
FIG. 4 is a schematic of the aspirator/mixer of the system of FIG. 1 referencing specific dimensions of the aspirator/mixer.

One hundred percent premixing of the fuel gas and combustion air has been obtained previously, without the use of a blower, in high pressure propane systems. But the minimally acceptable pressure of natural gas available at the gas manifold of a home appliance is about 6.5 mm. Hg. Heretofore, a blower has been required for 100% premixing of the gas and air. An aspirator/mixer design which enables 100% premixing of the fuel gas and air utilizing only the energy available from the flow line pressure of the natural gas is shown in FIG. 4.

The dimensions of the combustion air inlet diameter A, nozzle to throat distance B, mixer length C, diffuser length D, mixer throat diameter E, diffuser exit diameter F and elbow exit diameter G are given in the following table for a 40,000 BTU/hr burner and for a generalized burner, where Q is the firing rate in BTU/hr.

| Dimension | 40,000 BTU/hr burner (Inches) | Generalized burner (inches) |
|---|---|---|
| A | 4. | $.02\sqrt{Q}$ |
| B | 2.3 | $.011\sqrt{Q}$ |
| C | 5. | $.02\sqrt{Q}$ |
| D | 12. | $.06\sqrt{Q}$ |
| E | 1.6 | $.008\sqrt{Q}$ |
| F | 2.5 | $.01\sqrt{Q}$ |
| G | 3. | $.02\sqrt{Q}$ |

The most critical dimensions in that design for providing 100% premixing at 6.5 mm Hg manifold pressure are the nozzle to throat distance B and the mixing throat diameter E.

In order to reduce the size of any one aspirator/-mixer, the complete aspirator/mixer assembly may comprise more than one unit. Each unit would be as shown in FIG. 4. The dimensions of each unit would be scaled by the BTU/hr supplied by each unit. For example, in a 40,000 BTU/hr assembly having two aspirator/mixer units, each unit would be scaled according to the above table with Q equal to 20,000 BTU/hr.

A small gas nozzle 80 protrudes through the burner 58 to support a pilot flame 82. The pilot flame can be ignited by an arc between an electrode 84 and a flame-sensing thermocouple 86 or the nozzle 80. The arc is triggered by actuation of a switch 88 (FIG. 2). The pilot flame can be viewed through a window 89 in the shroud 76.

As noted above, in conventional systems little if any heat energy is derived from the pilot flame, and an object of this invention is to provide for substantial recovery of the heat of the pilot products of combustion. To that end, the arrangement shown in detail in FIG. 3 provides for radial flow of the combustion gases through the heat exchanger tubes 60. Because the combustion chamber within the heat exchanger assembly is small the flow path of products of combustion of the pilot past the heat exchanger assembly is short. Those products of combustion rise within the combustion chamber and flow along a strata over the cooler, off-cycle air in the combustion chamber. Because the pilot products of combustion do not mix with the cooler air to a significant degree before passing through the heat exchanger assembly, substantial recovery of the thermal energy from the pilot is recovered by the liquid within the heat exchanger.

The pilot products of combustion first flow into the region within the header 64 into heat exchange relationship with the header. Heat is extracted by the water in the header before the thus cooled pilot gases flow between the tubes 60, so there is only minimal heat exchange at those tubes. Also, those gases flow past the upper end of the heat exchanger tubes 60 and beneath the header 64. Further, the riser 60 is of a sufficiently large diameter that convection which results from the heating of water by the pilot flame is completed within the riser 68. During the off cycle, cold water flows down and hot water flows up the riser 68 as shown by the broken lines, and convection through the downcomer 66 is minimal. Thus there is no cooling of the hot water stored in the storage tank which might result with convective flow through the entire heat exchanger assembly during the off cycle.

This unique stratified flow of the pilot products of combustion past the heat exchanger assembly results primarily from the use of a small combustion chamber, surrounded by the water walled heat exchanger, with the pilot flame positioned such that the products of combustion follow a short path over cooler stationary air through the heat exchanger assembly.

Along with the stratified flow of pilot products of combustion, the arrangement of the heat exchanger assembly and of the exhaust flue relative to the storage tank minimize heat losses from the stored water during the off cycle.

The heat exchanger is external to the tank and is connected to the bottom of the tank. With natural stratification of water, the hottest water is at the top of the tank, completely out of heat exchange relationship with any off cycle convecting air. Only the least warm water in the tank is adjacent the downcomer and riser pipes 66 and 68. And even that water is substantially out of heat exchange relationship with the convecting air because, as noted above, convection of water down the downcomer pipe is avoided.

The flue completely bypasses the storage tank so that there is no heating of the off cycle air by the stored water. Off cycle flow through the flue results only from heat stored in the flue during the on cycle and from the pilot combustion. Even that flow is minimized by use of the preheating arrangement of the sleeve 38 around the flue 32.

Figure 5:
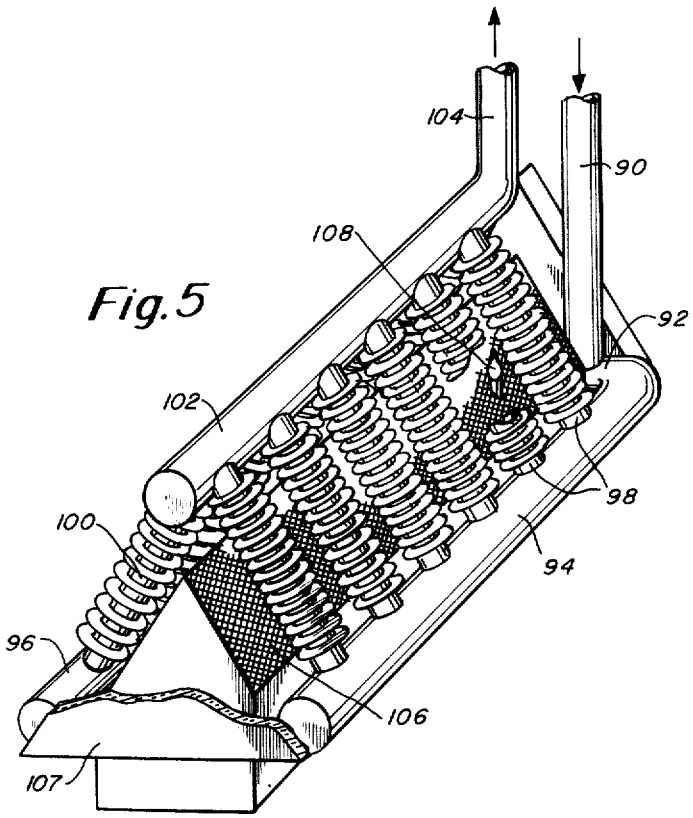
FIG. 5 is a perspective view of an alternative combustion chamber and heat exchanger in which the heat exchange tubes form a tent-like structure.

Another configuration of the water walled combustion chamber which provides for efficient heat exchange between the combustion products and the water during the heating cycle but which also minimizes off cycle heat exchange and provides for substantial recovery of the heat from the pilot flame is shown in FIG. 5. Water to be heated flows down through the downcomer pipe 90 into a pipe 92 which splits the water into two linear bottom headers 94 and 96. A number of heat exchanger tubes 98 and 100 angle upward to a single header tube 102 in a tent-like configuration. The water heated in the heat exchanger tubes and header flows up through the riser 104 to the storage tank by convection. A linear, two faced burner 106 also has an inverted-V shape and is positioned within the compact combustion chamber defined by the heat exchanger assembly. Each end and the bottom of the combustion chamber is closed by refractory material 107. As before, the pilot 108 is positioned so that its products of combustion follow a path upward and out through the heat exchanger tubes at the upper end thereof. The resultant stratified flow of the combustion products results in high recovery of the heat from those products.

Figure 6:
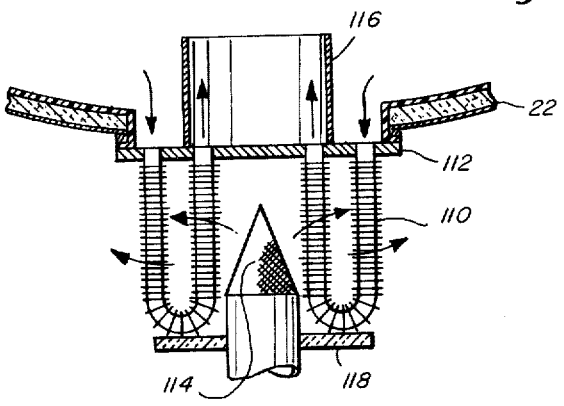
FIG. 6 is a partial elevational sectional view of yet another embodiment of the combustion chamber and heat exchanger in which the heat exchanger tubes are U-shaped tubes mounted directly to the water storage tank.
Figure 7:
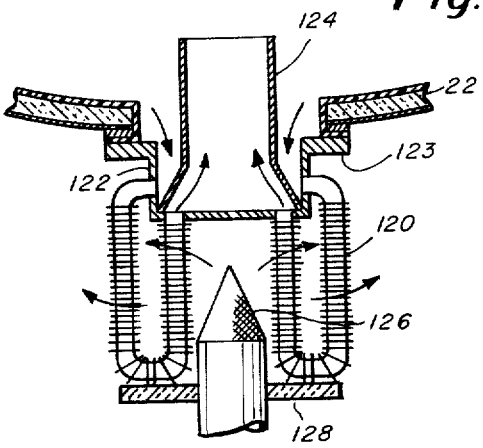
FIG. 7 is another embodiment of the combustion chamber and heat exchanger similar to that in FIG. 6 but with a modified connection to the storage tank.
Figure 8:
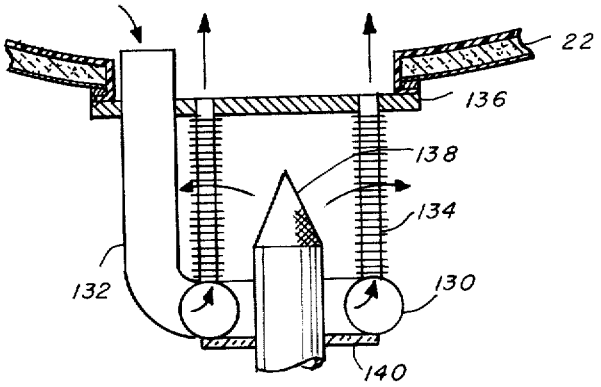
FIG. 8 is yet another alternative arrangement of the combustion chamber and heat exchanger in which the heat exchanger tubes extend between a bottom header and the storage tank.

Several modifications of the cylindrical array of tubes forming the heat exchanger/combustion chamber are shown in FIGS. 6–8. In FIG. 6, U-shaped heat exchanger tubes 110 are connected directly to the storage tank through the plate 112. The inner legs of the tubes define the combustion chamber and are heated by the burner 114. The outer legs of the tubes also extract heat from the combustion gases but to a lesser extent so that convective flow of the water through the tubes is induced. A flow directing ring 116 mounted to the top of the plate 112 keeps the heated water and the cooler water from the storage tank separate at the mouthes of the U-shaped tubes 110 to assure a proper convective flow through the tubes. As before, a bottom cap 118 of refractory material is provided. Unlike the embodiment of FIGS. 3 and 5, the combustion chamber in this embodiment is not completely isolated from the storage tank. There is some heat exchange between the combustion chamber and the water in the storage tank through the plate 112. This heat exchange is minimal, however, and because the water in the storage tank is stratified the warm pilot products of combustion are in heat exchange with the coolest water in the tank during the off cycle. Thus, there is still recovery of the heat from the pilot without the losses which result with the extended heat exchange surface of a conventional center flue system.

FIG. 7 shows a heat exchanger design similar to that in FIG. 6 but for use with a smaller opening at the bottom of the storage tank. In this embodiment, U-shaped heat exchanger tubes 120 are connected to a cup 122 below the plate 123. An annular flow divider 124 is provided as before. Also, a burner 126 is positioned within the heat exchanger element, and a plate of refractory material 128 is positioned below the combustion chamber.

In FIG. 8, a bottom header 130 is connected to the storage tank through a downcomer pipe 132 as in the embodiment of FIG. 3. In this case, however, the heat exchanger tubes 134 are straight tubes which extend from the bottom header 130 directly through the plate 136 into the storage tank. As before, the burner 138 is positioned within the combustion chamber defined by the heat exchanger tubes, and a refractory plate 140 is positioned below the combustion chamber.

Figure 9:
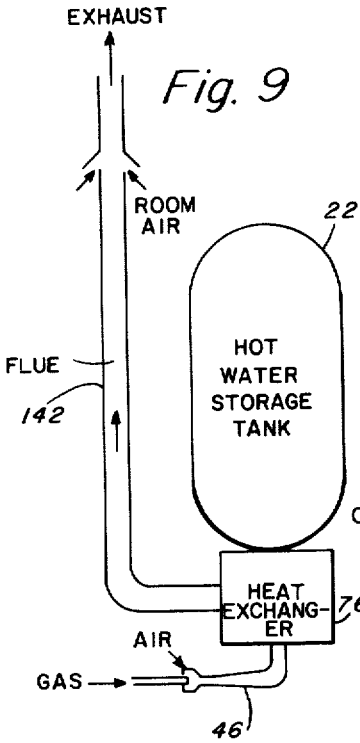
FIG. 9 is an alternative arrangement of the combustion air inlet in which the combustion air is not perheated.
Figure 10:
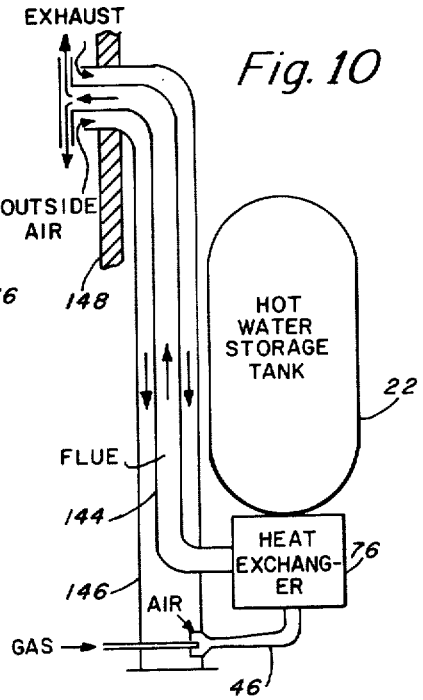
FIG. 10 is a schematic of another arrangement of the combustion air intake in which the combustion air is taken from outside of the building.
Figure 11:
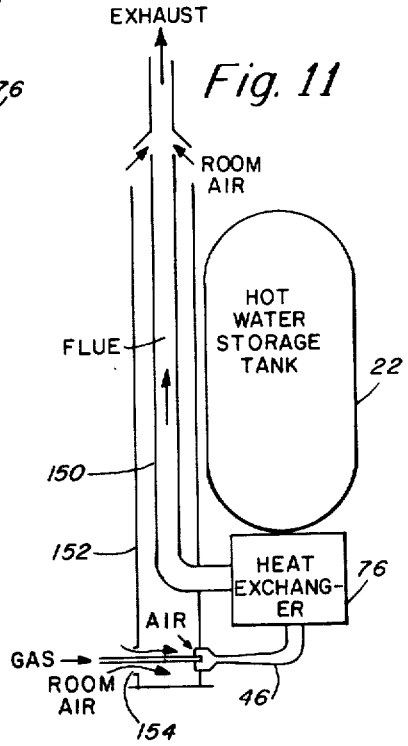
FIG. 11 is a schematic of yet another arrangement in which room air is provided directly to the aspirator but in which the flue is still surrounded by an insulating sleeve.

FIGS. 9, 10 and 11 show alternative arrangements of the combustion air inlet and the flue. In FIG. 9, combustion air is drawn directly from within the room in which the heater stands into the aspirator/mixer 46, and products of combustion pass up through a flue 142.

In the embodiment of FIG. 10, the flue 144 is surrounded by a sleeve 146. Combustion air is preheated in that sleeve before it is drawn into the aspirator/mixer 46 as in the embodiment of FIG. 1; but in this embodiment the combustion air is taken from outside of the exterior wall 148 so that conditioned air in the interior of the building is not extracted by the hot water heater system. This is the most efficient system.

In the embodiment of FIG. 11, the flue 150 is surrounded by a sleeve 152, but that sleeve is provided for insulating purposes only. Combustion air is taken from the building interior primarily through an opening 154 in the sleeve 152.

While the invention has been particularly shown and described with reference to preferred embodiments thereof, it will be understood by those skilled in the art that various changes in form and details may be made therein without departing from the spirit and scope of the appended claims.

We claim:

1. A storage water heater of the type having an insulated water storage tank, a water inlet and a water outlet to and from the water heater, and a gas fueled combustion assembly in which gas initially at line pressure or less naturally mixes with combustion air and is ignited in a combustion chamber to heat water in the storage tank, the water heater characterized in that:

the combustion chamber is positioned below and external to the storage tank, the combustion chamber wall comprising a plurality of generally vertical riser tubes surrounding a burner and through which all of the products of combustion flow radially, the upper ends of the riser tubes being in fluid communication with the storage tank and the lower ends of the riser tubes being in fluid communication with the storage tank through at least one downcomer tube, the riser and downcomer tubes defining a heat exchanger water passage with high and low points in the passage in liquid communication with the interior of the storage tank for flow of water through the heat exchanger passage to the storage tank by natural convection;

a burner is surrounded by the riser tubes of the combustion chamber; and a fuel gas nozzle adjacent to the burner for supporting a pilot flame is positioned such that the pilot products of combustion flow in a strata past the riser tubes at the upper ends thereof, the heat imparted to the liquid in the heat exchange water passage being insufficient to cause significant convective flow within the passage throughout the length of the heat exchanger passage.

2. A storage water heater of the type having an insulated water storage tank, a cold water inlet and a hot water outlet to and from the water heater, and a gas fuel combustion assembly in which gas initially at line pressure or less mixes with combustion air without power assist and is ignited in a combustion chamber to heat water in the storage tank, the water heater characterized in that:

the combustion chamber is positioned below and external to the storage tank, the combustion chamber walls comprising a plurality of generally vertical riser tubes surrounding a burner and through which all of the products of combustion flow radially, the upper ends of the riser tubes being in fluid communication with the storage tank and the lower ends of the riser tubes being in fluid communication with the bottom of the storage tank through at least one downcomer tube, the riser and downcomer tubes defining a heat exchange water passage with high and low points in the passage in liquid communication with the interior of the storage tank for flow of water through the heat exchange passage to the storage tank by natural convection;

in an aspirator/mixer assembly comprising a venturi mixer tube, an air inlet to the mixer tube and a fuel gas nozzle at the inlet which receives fuel gas at line pressure of 6.5 mm Hg or less, a gas jet is formed to draw air through the inlet to mix with the gas in the mixer tube, such that gas initially at line pressure of 6.5 mm Hg or less aspirates and mixes with an amount of air sufficient for complete combustion of the gas;

the premixed gas/air mixture is introduced from the preceeding aspirator/mixer assembly to a burner surrounded by the riser tubes of the combustion chamber and is substantially completely combusted within the water-walled combustion chamber; and the products of combustion exit the combustion chamber through an exhaust flue which is thermally isolated from the water in the storage tank.

3. A storage water heater as claimed in claim 1 wherein the tubes are in a cylindrical array within a shroud, the shroud being substantially closed to any combustion gas other than that gas which enters through the aspirator/mixer.

4. A storage water heater as claimed in claim 3 wherein the tubes are in liquid communication with a bottom header which surrounds a conduit between the aspirator/mixer and the burner and which is in liquid communication with the storage tank through a downcomer pipe.

5. A storage water heater as claimed in claim 4 wherein the riser tubes are in liquid communication with an upper, horizontal header which is in liquid communication with the storage tank through a vertical riser piper, the combustion chamber being thermally isolated from the storage tank except through the downcomer and riser pipes.

6. A storage water heater as claimed in claim 3 wherein the burner comprises foraminous sheet material.

7. A storage water heater as claimed in claim 1 wherein the tubes are positioned within a shroud which is closed to combustion gases other than those gases from the aspirator/mixer.

8. A storage water heater as claimed in claim 1 further comprising a gas nozzle in the combustion chamber for supporting a pilot flame, the gas nozzle being positioned such that the pilot products of combustion flow in a strata within the combustion chamber adjacent to a heat exchange surface at the top thereof past the heat exchanger tubes at the upper ends thereof.

9. A storage water heater as claimed in claim 1 wherein the aspirator/mixer assembly includes at least one aspirator/mixer unit, each unit comprising a fuel gas inlet nozzle within a combustion air inlet and directed to accelerate the fuel gas into a mixing throat such that the fuel gas draws the combustion air into the mixing throat, and wherein, for each unit, the distance in inches from the fuel gas nozzle to the mixing throat is $0.011\sqrt{Q}$, and the mixing throat diameter is $0.008\sqrt{Q}$, where Q is the rate of power input from the unit in BTU/hour.

10. A storage water heater as claimed in claim 1 wherein the water storage tank is a plastic-lined, insulated storage tank.

11. A storage water heater as claimed in claim 1 in which combustion air introduced to the aspirator/mixer is first passed in heat exchange relationship with the flue gases to preheat the combustion air.

12. A storage water heater as claimed in claim 1 wherein the combustion chamber is closed to combustion gases other than those gases from the aspirator/mixer.

* * * * *